US005340953A

United States Patent [19]

Krebs et al.

[11] Patent Number: 5,340,953

[45] Date of Patent: Aug. 23, 1994

[54] SWITCH CONTROLLER

[75] Inventors: Paul B. Krebs; Shawn R. Irwin, both of Newberg, Oreg.

[73] Assignee: A-Dec, Inc., Newberg, Oreg.

[21] Appl. No.: 978,876

[22] Filed: Nov. 19, 1992

[51] Int. Cl.[5] ..... H01H 3/14; A61G 15/02

[52] U.S. Cl. ..... 200/86.5; 200/5 R; 297/330

[58] Field of Search ..... 200/5 R, 5 A, 6 R, 6 A, 200/18, 86.5, 511, 512, 517; 297/71, 330

[56] References Cited

U.S. PATENT DOCUMENTS

| | | | |
|---|---|---|---|
| 1,446,636 | 2/1923 | Bissel | 200/302.1 |
| 3,046,591 | 7/1962 | Prohaska et al. | 200/302.1 |
| 3,414,324 | 12/1968 | Taylor et al. | 297/90 |
| 3,821,531 | 6/1974 | Halbach et al. | 200/302.1 |
| 3,934,928 | 1/1976 | Johnson | 297/71 |
| 4,031,348 | 6/1977 | Eberhardt | 200/302 |
| 4,264,849 | 4/1981 | Fleischer et al. | 318/568 |
| 4,349,708 | 9/1982 | Asher | 200/6 A |
| 4,655,505 | 4/1987 | Kashiwamura et al. | 297/284 |
| 4,676,750 | 6/1987 | Mason | 200/51 |
| 4,684,767 | 8/1987 | Phalen | 433/101 |
| 4,687,200 | 8/1987 | Shirai | 273/148 B |
| 5,086,313 | 2/1992 | Misawa | 200/5 R |
| 5,190,349 | 3/1993 | Austin, Jr. et al. | 297/316 |

FOREIGN PATENT DOCUMENTS

| | | | |
|---|---|---|---|
| 2736276 | 11/1978 | Fed. Rep. of Germany | A01G 15/00 |
| 3222832 | 12/1983 | Fed. Rep. of Germany | G05B 19/19 |

OTHER PUBLICATIONS

Belmont Brochure *Safety Protection for Professionals The PROII,* 8 pages, U.S., 1986.

A-Dec Brochure *A-Dec's New Decade 1015 Chair: Designed for Infection Control From the Group up,* 8 pages, U.S., 1990.

Belmont Catalog, 38 pages, Japan, date unknown.

A-Dec Brochure *The A-Dec Priority Chair: Beauty Goes to Work,* 10 pages, U.S., 1989.

DieFaszination des Fortschritts. KaVo Estetica 1042. Die Behandlungseinheit, 17 pages, Germany, date unknown.

Planmeca Oy brochure *PM 2002 CC,* 4 pages, Helsinki, Finland, Date unknown.

Healthco International, Inc. brochure *Introducing the Celebrity Dental Chair,* 1 page, origin unknown, Apr. 1987.

Healthco International, Inc. brochure *Aristocrat Deluxe Dental Chair,* 2 pages, Helsinki, Finland, date unknown.

Pelton & Crane brochure *The System 5000E,* 4 pages, U.S., 1991.

Takara Belmont 50-page dental equipment catalog, cover and p. 13, circa Jan. 1991.

Anthos "Teseo" six-page brochure circa Jan. 1992.

A-Dec 117-page equipment catalog, cover and p. 41, Jan. 1991.

KaVo "Estetica ©1042" German language 13-page brochure, pp. 1, 8, circa Jan. 1991.

A-Dec 121-page catalog, cover and pp. 26, 33, 43, circa Sep. 1991.

A-Dec "J-Dec" two-page Japanese language brochure circa Jan. 1991.

(List continued on next page.)

*Primary Examiner*—A. D. Pellinen
*Assistant Examiner*—Michael A. Friedhofer
*Attorney, Agent, or Firm*—Klarquist, Sparkman, Campbell, Leigh & Whinston

[57] ABSTRACT

A switch controller having a housing cover with a central ridge and opposed top surfaces which incline downwardly away from the central ridge. The top surfaces also incline on progressing from one end of the housing to the opposite end. A pair of footpads are mounted on the upper surface of the housing and incline consistently with their associated portions of the housing surfaces. The under surfaces of the footpads have spaced apart contact points thereon. Underlying the contact points are associated switches which are actuated by pressing downwardly on selected regions of the footpads. Fulcrum means are disposed between the associated pairs of contact points and switches to inhibit simultaneous actuation of adjacent switches.

28 Claims, 5 Drawing Sheets

OTHER PUBLICATIONS

Tecnodent two-page brochure, circa Jan. 1991.

Planmeca Oy eight-page "PM 2002 CC" brochure, circa Jan. 1989.

ETI four-page brochure, cover and one page, circa Jan. 1991.

Marus Dental Equipment 15-page catalog, cover and page 20, Mar. 1982.

Osada "FX Series" 31-page Japanese language brochure, cover and pp. 3-5, circa Jan. 1991.

Dentech 32-page catalog, cover and p. 20, circa Jan. 1991.

Ampco Dental Products four-page brochure, first page, circa Jan. 1991.

Takara Belmont 36-page Japanese language brochure, cover and pp. 17-18, circa Jan. 1991.

Siemens 27-page catalog, cover and pp. 20-27, Feb. 1991.

J. Morita Corporation "Surpass" 21-page Japanese language brochure, cover and p. 21, circa Jan. 1991.

Ritter Dental Console Operator's three-page manual, first two pages, 1967.

A-Dec Equipment Accessories one-page price list, Sep. 1968.

S-T Products "Performers" six-page brochure, first page, Jul. 1983.

Fimet oy "F1" six-page brochure, pp. 1, 4, circa Jan. 1991.

Elan 2000 III 20-page Japanese language catalog, cover and p. 10, Circa Jan. 1991.

Belmont one-page photograph, circa Jan. 1991.

English language Abstract to German patent DE 27 36 276.

English language Abstract to German patent DE 29 41 185.

English language Abstract to German patent DE 32 22 832.

24
26
34c
26c
30a
34
36
30
74e
74c
30d
44

30
7
30g
74f
76
74g
74b
30f
74c
30h
74
30b
74e
30a
74a
30e
74d
30c
7
70
6
30a
30b
30e
30g
76
30
74h
74c
30d
74b
74a
74
30h
74d
30c
6

SWITCH CONTROLLER

FIELD OF THE INVENTION

This invention relates to a switch controller, and more particularly to a foot switch control for selecting the position for a chair, such as a dental chair.

BACKGROUND OF THE INVENTION

Multiposition chairs are used in many areas. One use is found in the modern dental office, where the dental chair often includes mechanism for raising and lowering the chair seat and for tilting the chair forward and rearward. This allows the operator to position the chair and the patient for convenient operation by the dentist, and to another position more convenient for entering and exiting by the patient.

Explaining further, the chair is placed in a first position for ease of entry by the patient. After the patient is seated the dentist operates the chair to move the patient into a position appropriate for the dental procedure to be undertaken. Upon completion of the procedure, the chair is repositioned to allow the patient to exit the chair.

A primary consideration in such procedure is providing a control means which allows the operator to conveniently and precisely position and reposition the chair. It has been found that a foot switch connected to operating mechanism for the chair and situated near the chair is convenient for the operator.

As stated, such chairs generally include operating controls permitting selected raising and lowering of the chair and forward and rearward tilt of the chair. Further, operating mechanism often is included which allows certain preselected positions to be established in an electronic memory for the chair, whereby the closing of a single switch actuates operating mechanism in the chair to move the chair automatically to a selected preprogrammed position.

It would therefore be convenient for the operator to have two sets of independently operable switches. One set would be adapted to allow infinite variation of movement of the chair (such as raising and lowering and forward and rearward tilt) and the second set of switches would be operable to actuate the chair to shift automatically to selected preprogrammed positions.

Although it is desirable to have separate foot switch controls on a single unit, they must be placed so that they are adequately separated to prevent concurrent actuation by the user's foot. They also must be conveniently positioned and of a sufficiently small size that they are not an impediment in the floor area surrounding the chair.

A general object of the present invention is to provide a switch controller which is inexpensively constructed, convenient to use and which provides multiple switch controls for associated operating mechanism.

More specifically, an object of the invention is to provide a plurality of spaced apart pressure sensitive switches and a control pad with a plurality of contact points overlying the switches, each of which contact points is associated with an individual switch to define a contact pair therebetween. A fulcrum element is provided between adjacent contact pairs to inhibit simultaneous actuation of adjacent switches by their associated contact points.

A still further object of the present invention is to provide such a novel controller wherein the control pad is an elastomeric footpad secured at its periphery in a housing with the upper surface of the pad engageable by the foot of the user. The footpad has contact points on its underside to contact and actuate pressure sensitive micro switches disposed thereunder. A universal pivot mount is provided for the footpad to permit universal pivoting of the pad between actuating and nonactuating positions.

Another object of the present invention is to provide a novel foot switch for operating a patient chair which includes a pair of footpads each of which is operable to produce different operational movement of the chair. The footpads are mounted on a housing which has a central ridge region-and upper support surfaces which incline downwardly from opposite sides of the ridge region. One footpad is supported on one inclined surface of the housing, and the other footpad is supported on the opposite inclined support surface. Such construction permits the two footpads to be positioned rather closely together to provide a compact dual foot switch, yet provides a mode of separation between the two to inhibit user actuation of both at the same time.

A still further object of the present invention is to provide such a novel foot switch or controller which has a third switch mounted on the ridge region of the housing and a bumper projection extending upwardly from the ridge region adjacent the third button and intermediate the two previously mentioned footpads.

Yet another object of the invention is to provide a novel foot switch for use in operating a patient chair which includes a housing cover with a defined opening therein, and a footpad formed as an integral elastomeric member having a peripheral groove therein for receiving and gripping the edge margins of the opening in the housing. The footpad spans the opening in the housing to provide a full covering overlying internal switch mechanism to prevent contamination of the switch mechanism.

These and other objects and advantages will become more fully apparent as the following description is read in conjunction with the drawings.

DETAILED DESCRIPTION OF A PREFERRED EMBODIMENT

Figure 1:
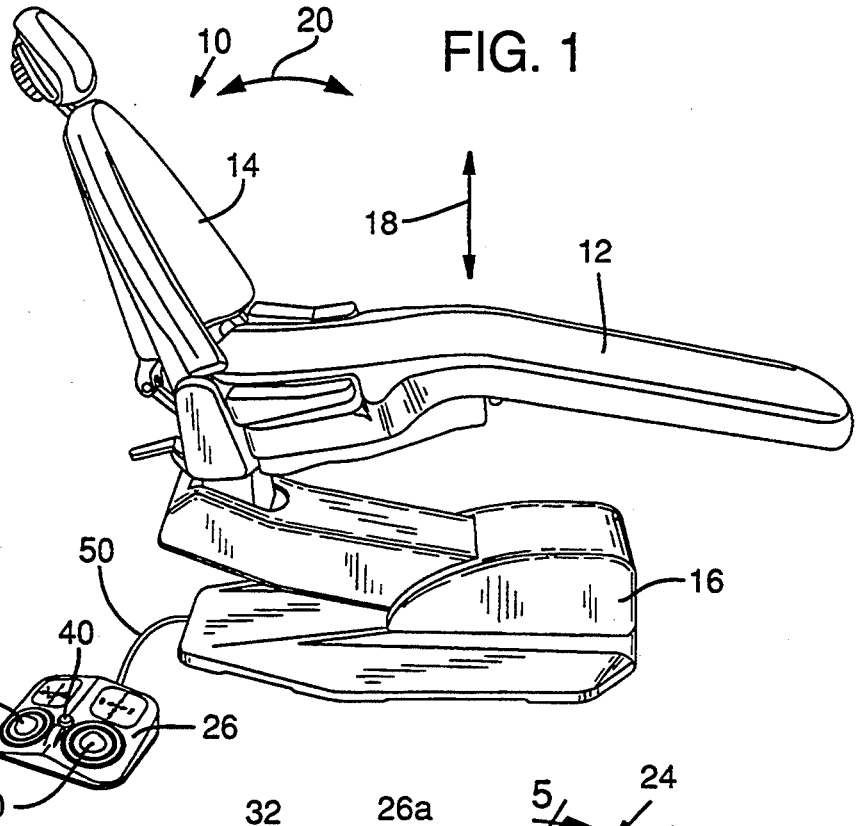
FIG. 1 is a perspective view of a multiposition patient chair with an associated foot switch controller according to an embodiment of the invention.

Referring to the drawings, and first more particularly to FIG. 1, at 10 is indicated generally a patient chair, such as would be used by a dentist. The chair includes a seat 12 and a back 14 which is pivotally connected thereto. Both are mounted on a chair base 16 which includes mechanism operable to raise and lower the chair in the directions of arrow 18 and to tilt the chair forwardly and rearwardly as indicated by double headed arrow 20.

The chair is shiftable to a variety of positions. First, the chair may be placed in an initial position which is convenient to be entered or exited by a patient. After the patient is seated, it may be raised and tilted rearwardly to position the patient so that it is most convenient for the dentist to work.

The chair is controlled by a microprocessor-based control system that includes input switches for initiating raising, lowering and tilting of the chair back and seat portions, sensing mechanism for continuously providing signals representing the chair position, and actuators for moving the chair components under the control of the microprocessor. Not only may the chair be moved to a variety of positions through actuation of switching controls, but it also may employ sensing mechanism in conjunction with a memory device to permit the operator to designate a particular position to which the chair should be moved any time a corresponding input switch is closed by the operator.

Explaining in greater detail, switching may be provided allowing the operator to selectively raise or lower the chair to any position desired, or tilt the chair rearwardly or forwardly to any position within its defined mechanical limits. Alternately, the user may program into the control system memory a number of selected positions to which the chair will move automatically upon actuation of certain switches by the operator.

The chair may be initially in a lowered position with the seat and back tilted to their forward-most position for ease of entry by a patient. Once the patient has been seated on the chair, the operator may operate selected switches to raise the chair to any height within its mechanical limits, and may tilt it rearwardly to any selected position within its mechanical limits. Thus the operator has virtually an infinite number of positions into which the chair and patient may be placed. Alternately, a number of preselected positions may be programmed into the system to which the chair will automatically move upon actuation of a selected switch. For example, actuation of a selected switch may move the chair to its lowered and forward-most position to allow patient entry or exit. Actuation of a second switch could move the chair to place the patient in a convenient position for working on by the operator.

Such a chair and control system are described in pending United States patent application Ser. Nos. 07/501,674, filed Mar. 29, 1990, assigned to the same assignee as the present invention. The disclosure of the '674 application is incorporated herein by reference.

Figure 2:
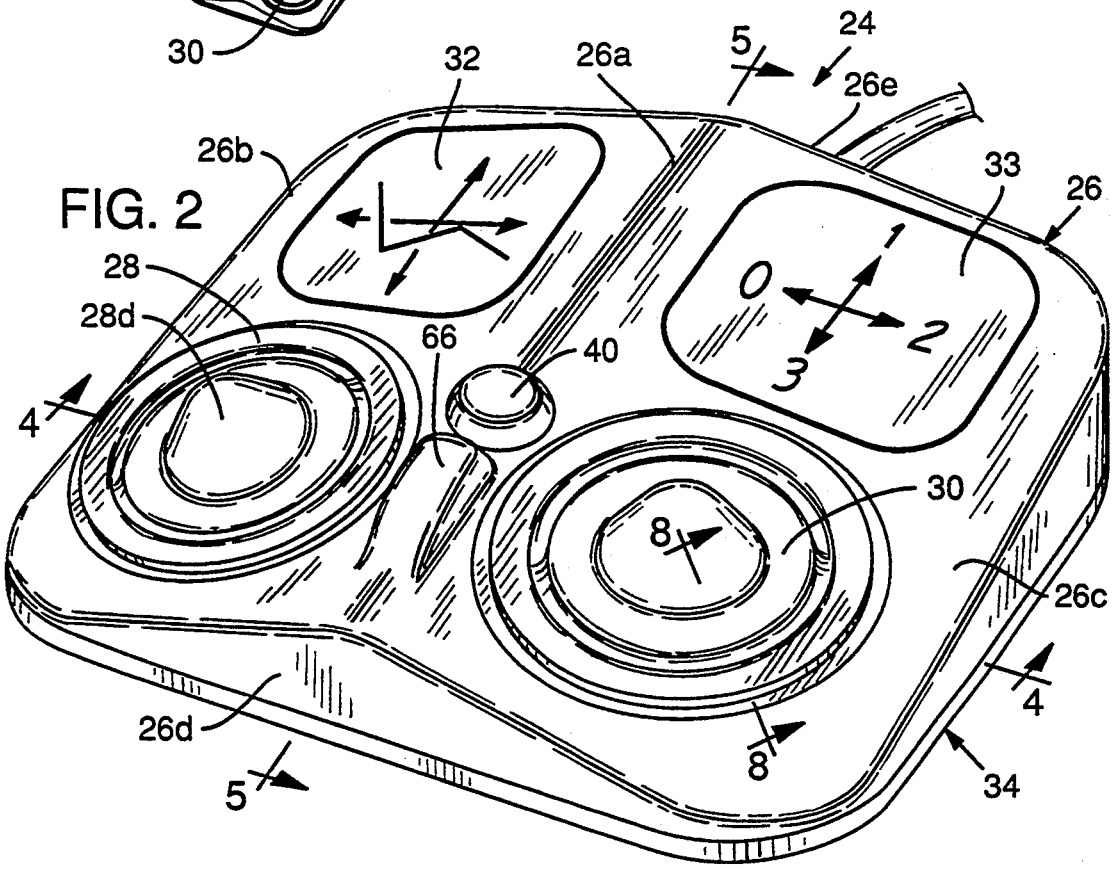
FIG. 2 is an enlarged perspective view of the foot switch controller of the invention.

Referring to FIGS. 1 and 2, at 24 is noted a foot switch, or controller, according to an embodiment of the invention, operable to provide switch signal actuation for operating chair 10. The foot switch includes a housing cover 26 on which are mounted a pair of footpads, or control elements, 28, 30.

Adjacent footpad 28 is an illustration 32 indicating movement of chair 10 which will be produced upon pressing the footpad in the directions of the arrows illustrated, as will be explained in greater detail below. Adjacent footpad 30 is a second illustration 33 indicating four preprogrammed positions to which the chair may be moved upon shifting the footpad in the noted direction, again as will be described in greater detail below.

Figure 3:
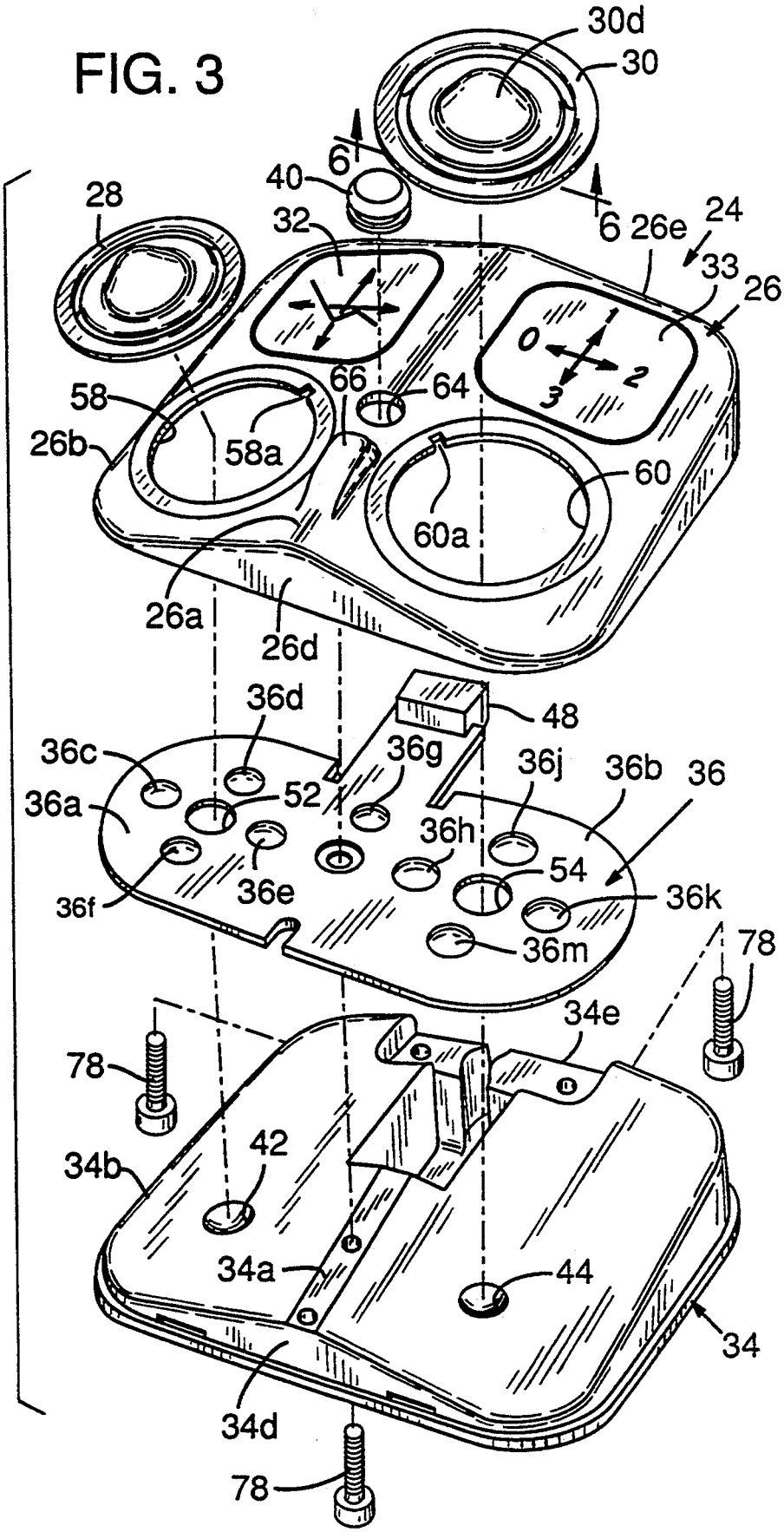
FIG. 3 is an exploded perspective view of major component parts of the present invention.

Referring to FIG. 3, the major components of the foot switch are illustrated in exploded view. It includes a base 34, a switch pad 36, housing cover 26, footpads 28, 30 and a programming button 40.

Figure 4:
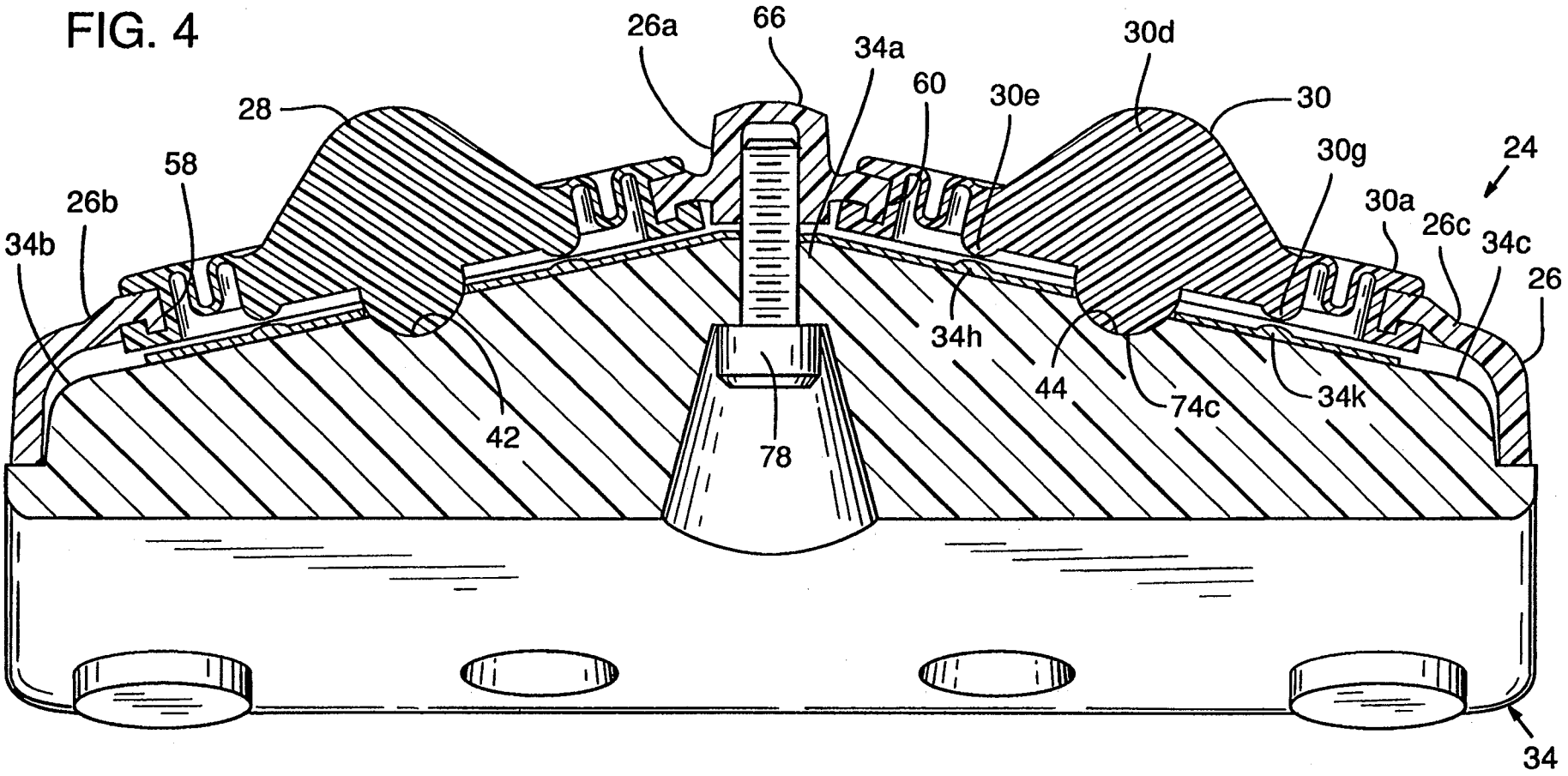
FIG. 4 is an enlarged cross-sectional view taken generally along the line 4—4 in FIG. 2.

Describing the elements in greater detail, base 34 is a substantially rigid box-like member having an upper surface with a central ridge region **34*a* and inclined top surface portions 34*b*, 34*c* sloping downwardly from opposite sides of ridge region 34*a* (see FIG. 4). A pair of semispherical depressions 42, 44 are formed in surfaces 34*b*, 34*c*, respectively. Opposite end walls are denoted at 34*d*, 34*e*. End wall 34*d*, nearest the viewer in FIG. 3, is shorter than end wall 34*e*. Ridge region 34*a*, and surfaces 34*b*, 34*c* slope upwardly on progressing from end 34*d* toward end 34*e***.

Switch pad 36 is a substantially flat membrane switch pad having a pair of wing sections **36*a*, 36*b*. The switch pad is of generally known construction having upper and lower elastomeric pad portions of nonconductive material. Secured between the two layers of nonconductive material are pairs of electronic switch circuit leads normally disposed in noncontacting proximity. Domed regions 36*c*, 36*d*, 36*e*, 36*f*, 36*g*, 36*h*, 36*j*, 36*k*, and 36*m* house such switch circuit leads. Each of these regions forms a pressure sensitive switch, or microswitch, to which a pair of switch circuit leads is connected. When a domed region is compressed its switch contacts are closed to transmit an output signal to connector 48. Connector 48 is connected to cable 50 which carries signals to appropriate control circuits in chair base 16**.

Areas of the switch pad 36 between immediately adjacent domed regions (for example between regions **36*k*, 36*m***) are devoid of switch current leads. The purpose for such will be explained below.

The switch pad has a pair of apertures 52, 54 which are generally aligned with depressions 42, 44 in base 34. When assembled, the switch pad rests flush atop upper surfaces **34*a*, 34*b*, 34*c* of the base and apertures 52, 54 are aligned with depressions 42, 44**, respectively.

It will be noted that switches **36*c*, 36*d*, 36*e*, and 36*f* are arrayed in spaced apart relationship about the central region occupied by aperture 52. Similarly, switches 36*h*, 36*j*, 36*k*, 36*m* are arrayed in spaced apart relation about a central region occupied by opening 54**.

Housing cover 26 has a central ridge region **26*a* which extends lengthwise of the housing cover in a region to overlie ridge region 34*a* of the base. Upper surfaces, or support regions, 26*b*, 26*c* incline downwardly from central ridge region 26*a* on progressing toward opposite sides thereof. The housing also has a pair of opposite upright ends 26*d*, 26*e*. End 26*d* is shorter than end 26*e*. Ridge region 26*a* and upper surfaces 26*b*, 26*c* of the housing cover slope upwardly on progressing from end 26*d* toward end 26*e***.

A pair of circular openings, or apertures, 58, 60 are formed in support surfaces **26*b*, 26*c*, respectively. Each has a keyway formed therein at a specifically defined location as noted at 58*a*, 60*a***, respectively.

A third and smaller opening 64 is defined in the ridge region of the housing cover over switch **36*g*. A bumper protrusion 66 projects upwardly from the ridge region adjacent opening 64 and intermediate openings 58, 60**.

Figures 6, 7, 8:
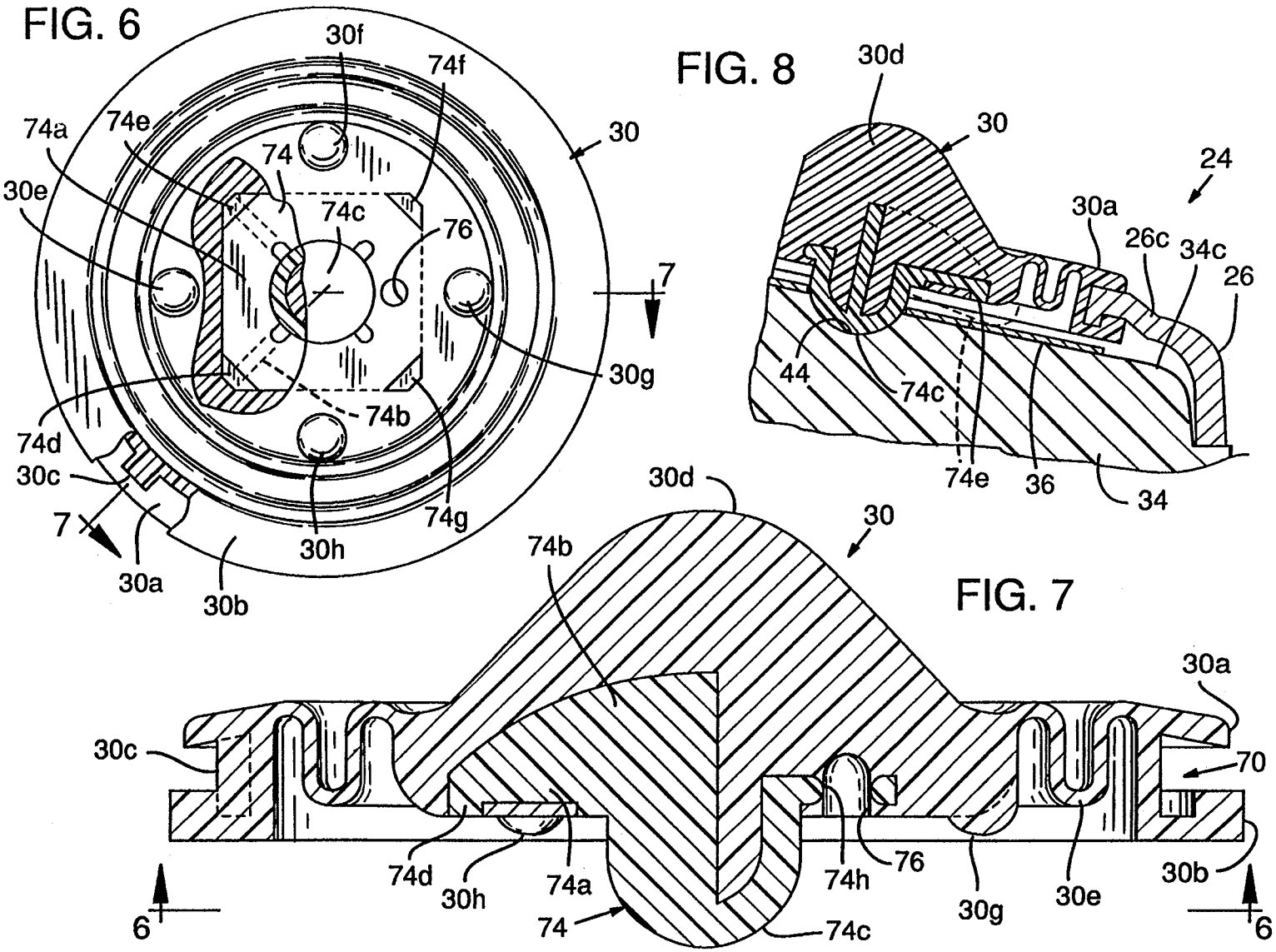
FIG. 6 is a bottom view of a footpad in the invention taken generally along the line 6—6 in FIG. 3.
FIG. 7 is an enlarged cross-sectional view taken generally along the line 7—7 in FIG. 6.
FIG. 8 is an enlarged cross-sectional view taken generally along the line 8—8 in FIG. 2.

Each of footpads 28, 30 is identical, and thus, only one will be described in detail herein. Referring to FIGS. 6 and 7, it will be seen that footpad 30 comprises a preformed circular elastomeric pad having upper and lower annular peripheral lips 30*a*, 30*b* which define an annular peripheral groove 70 therebetween. The annular groove receives marginal edge portions of opening 60 of the housing 26 and tightly grips the same to secure the footpad in the housing. This is best illustrated in FIG. 4. The footpad extends fully across opening 60 to provide a sealing closure overlying the switch pad. A key portion 30*c* (FIGS. 6 and 7) formed within groove 70 on the footpad is received in keyway 60*a* (FIG. 3) of opening 60 to properly orient the footpad in the housing cover.

The central portion 30*d* of the footpad is of a rounded upwardly protruding shape which projects above the level of annular lip 30*a*, and thus above the upper surface of housing 26. Formed between annular lips 30*a*, 30*b* and central portion 30*d* is an annular flexing region comprising a multiple bend bellows configuration 30*e*. With annular lips 30*a*, 30*b* secured to and substantially immovable relative to the housing cover, bellows portion 30*e* permits limited vertical movement of central portion 30*d* of the footpad. The flexing region is such that if the central portion is 30*d* moved from the normally at-rest position illustrated in FIGS. 4 and 7, the resiliency of the flexing region will return the central portion to the illustrated at-rest position.

Four downwardly projecting rounded contact points 30*e*, 30*f*, 30*g*, 30*h* are arrayed in spaced apart relationship about the center of the footpad. When the footpad is secured in the housing cover with key 30*c* properly meshed with keyway 60*a*, each contact point 30*e*, 30*f*, 30*g*, 30*h* overlie a switch 36*h*, 36*j*, 36*k*, 36*m*, respectively. Each contact point and its associated underlying switch form what is referred to herein as a contact pair which is spaced from other contact pairs in the assembly.

Embedded and thereby secured within footpad 28 is a substantially rigid plastic member 74. A portion of the underside of footpad 30 is broken away in FIG. 6 to expose a part of member 74 to view. Member 74 has a substantially planar, square base portion 74*a* which is disposed substantially horizontally and embedded within the molded elastomeric material of footpad 30. Upright stiffening ribs, a portion of one of which is indicated generally at 74*b*, project upwardly from base 74*a*. A central universal swivel mount portion 74*c* projects downwardly from base portion 74*a* and the underside of footpad 30. The distal end of portion 74*c* is formed in a semispherical configuration.

Fulcrum projections 74*d*, 74*e*, 74*f*, 74*g* extend downwardly from base portion 74*a* to the plane of the underside of the central region of footpad 28. As is seen in FIG. 6, these projections are positioned intermediate adjacent contact points and are on a substantially similar radius with the contact points.

An aperture 74*h* is defined in element 74 for the purpose of properly orienting element 74 when it is being embedded into footpad 30. Explaining further, when footpad 30 is formed, element 74 is placed in the mold, and a pin within the mold extends through bore 74*h* to properly align element 74 therein. Elastomeric material in liquid form is injected into the mold to form footpad 30 and embed element 74 therein. In the resultant combined part the positioning pin orientation is noted by opening 76 on the underside of the molded part.

Upon assembly of the device, as has been noted previously, switch pad 36 rests upon base 34 with apertures 52, 54 aligned with depressions 42, 44 in the base. Housing cover 26 is set in fitting relationship onto base 34 with semispherical end portions 74*c* of the footpads 28, 30 extending through apertures 52, 54 and resting in depressions 42, 44, respectively. Screws 78 serve to secure the housing cover to the base.

Figure 5:
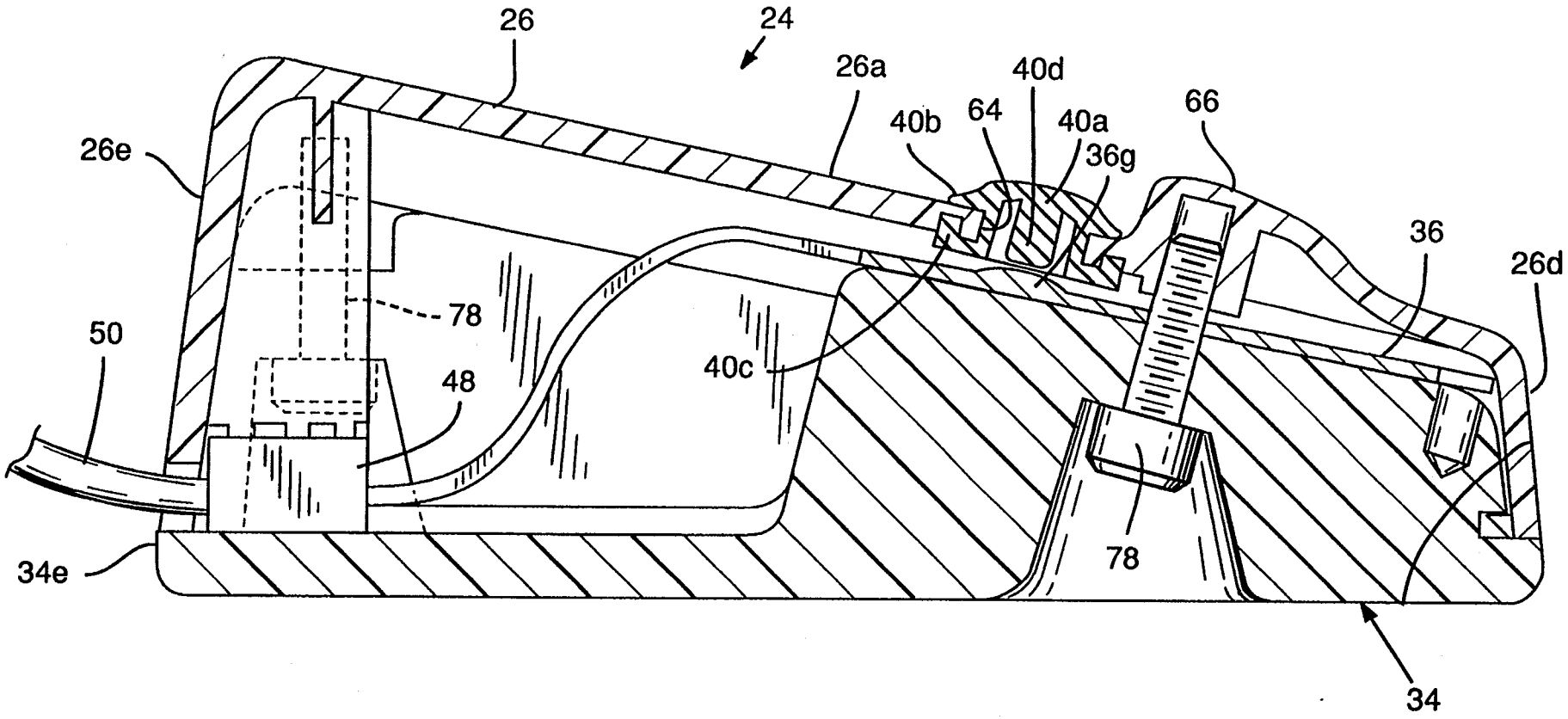
FIG. 5 is an enlarged cross-section view taken generally along the line 5—5 in FIG. 2.

Referring to FIG. 5, programming button 40 has a central, upwardly rounded portion 40*a* and a pair of upper and lower peripheral lips 40*b*, 40*c* extending thereabout. These lips define an annular groove adapted to receive the marginal edge portions of opening 64 in the ridge region of the housing cover. A central contact portion 40*d* extends downwardly from top portion 40*a* in a position normally spaced above switch 36*g*. Button 40 is sufficiently flexible that the operator may press downwardly on the top of portion 40*a* to press contact portion 40*d* into contact with and actuate switch 36*g*. Upon release of such pressure, the resilience of button 40 is such that portion 40*d* is again lifted to a position spaced above switch 36*g*.

With the parts thus assembled, footpads 28, 30 are oriented in inclined positions conforming to the incline of their respective housing cover top regions 26*b*, 26*c*. Explaining further, and referring to FIG. 2, footpad 28 is inclined upwardly on progressing from the left to the right and is inclined upwardly on progressing away from the viewer. Footpad 30 slopes downwardly on progressing from the left to the right and inclines upwardly on progressing away from the viewer. The central protrusion 66 is positioned intermediate the two footpads. This orientation of the two footpads provides comfortable positioning for the operator's foot while separating the two to prevent inadvertent operation of one footpad while actuating the other.

Referring to FIG. 4, each footpad 28, 30 in its normally at-rest position is oriented with its contact pointed spaced from their respective switches. The user may press the footpad in a selected direction to move the footpad whereby a selected contact point engages and activates its associated underlying switch. The central regions of the footpads bearing the contact points are supported by the semispherical end of portion 74*c* and the bellows support portion 30*e* for substantially universal movement. Universal movement is defined herein to mean pivotal movement about a plurality of angularly disposed axes.

As stated previously, each contact point and its associated switch define what is referred to as a contact pair. The fulcrum projections 74*d*, 74*e*, 74*f*, 74*g* on the underside of the footpad are disposed intermediate spaced contact pairs. Should the operator press the footpad downwardly in a region between a pair of contact points, a fulcrum projection will come into contact with the upper surface of the switch plate prior to actuation of the switch on either side of the fulcrum projection. This inhibits simultaneous actuation of adjacent switches.

Explaining further, and referring to the FIG. 5, projection 74*e* is positioned above a region of switchpad 36 that is devoid of Switch contacts. If the operator presses the footpad down in the direction of projection 74*e* it will contact the switch pad as shown in dashed outline before the contact points on either side thereof actuate their associated underlying switches. Were the fulcrum projection not provided, two adjacent switches might be actuated simultaneously.

Describing operation of the device in relation to the chair, and referring to FIG. 2, if an operator wishes to place the chair in a position which is not already programmed into its memory, the operator merely moves foot switch 28 in the appropriate directions to maneuver the chair. For example, pressing the footpad 28 forwardly actuates switch 36*d* to raise the chair, and conversely moving the footpad rearwardly as seen in FIG. 2 actuates switch 36*f* to lower the chair. Similarly, moving footpad 28 to the left actuates switch 36*c* to tilt the chair rearwardly and shifting the footpad to the right actuates switch 36*e* to tilt the chair forwardly.

Preprogramming the chair for preselected positions is a simple matter. The operator merely moves the chair to the position desired using footpad 28, then depresses button 40 actuating microswitch 36*g*. This begins the setting of the programming routine of the microprocessor controlled chair. After pressing button 40 to actuate switch 36*g*, the operator presses foot switch 30 in a selected direction for positions 0, 1, 2, or 3, as noted on the illustration to actuate either of switches 36*h*, 36*j*, 36*k*, or 36*m*. Upon movement of the foot switch to the selected position the present position of the chair is preprogrammed into memory. Different positions then can be programmed so that at a later time the user may reorient the chair to a preprogrammed position merely by pressing footpad 30 to the selected position.

Although a preferred embodiment of the invention has been described herein, it should be recognized that variations and modifications are possible without departing from the spirit of the invention as set out in the following claims.

We claim:

1. A foot switch controller for a multiposition chair having powered mechanism operable to move the chair between selected positions, said controller comprising a base, a first set of spaced-apart pressuresensitive switches supported on said base, each switch being adapted for being operatively connected to the powered mechanism to produce selected movement of the chair, a second set of spaced-apart pressure-sensitive switches supported on said base, each switch being adapted for being operatively connected to the powered mechanism to produce selected movement of the chair, a first footpad overlying said base and said first set of switches and a second footpad overlying said base and said second set of switches, each of said first and second footpads having an upper user-engaging surface and a plurality of spacedapart contact points thereon each of which faces an associated one of said switches, and support means for supporting said footpads in normally nonactuating positions in which said contact points are spaced from said switches and permitting selected movement of a footpad toward the base whereby selected contact points engage their associated switches, said support means comprising a housing cover having a central ridge region and oppositely disposed substantially planar first and second support regions which incline downwardly substantially continuously from opposite sides of said ridge region, said first-mentioned footpad being mounted on and inclined with said first support region and said second footpad being mounted on and inclined with said second support region.

2. The foot switch of claim 1, which further comprises a third footpad and an associated underlying switch intermediate said first and second sets of switches and footpads, said third footpad being mounted in said ridge region of the housing cover.

3. The foot switch of claim 2, which further comprises a bumper on said housing cover projecting upwardly from said ridge region adjacent said third footpad and intermediate said first-mentioned and second footpads.

4. The foot switch of claim 1, in which said ridge region is inclined upwardly in a direction progressing from one end of said housing cover toward the other end and said support regions also are inclined upwardly in said direction.

5. The foot switch of claim 1, wherein said support means comprises a housing cover having an opening defined therein and said footpad comprises an elastomeric element supported in said opening with an upper userengaging surface of the footpad spaced above the upper surface of said housing cover.

6. The foot switch of claim 5, wherein said elastomeric element has securing means adjacent its outer edges operable to secure said element to said housing cover.

7. The foot switch of claim 6, wherein said housing cover has a defined thickness at edge margins of said opening and said securing means comprises a peripheral groove defined in the outer margins of the elastomeric element having a groove width for receiving and gripping said housing cover edge margins.

8. The foot switch of claim 6, wherein said elastomeric element is a continuous integral member spanning the opening in said housing cover.

9. The foot switch of claim 8, wherein said elastomeric element has a user-engaging region of a first thickness permitting Said region to project above the level of the housing cover and a flexing region spaced from said central region of lesser thickness to facilitate movement of said footpad between its nonactuating and actuating positions.

10. The foot switch of claim 9, wherein said flexing region has a multiple-bend bellows configuration.

11. The foot switch of claim 1, wherein said switches are arrayed about a central region on said base, said contact points are similarly arrayed about a central region of said footpad, and said support means comprises a universal swivel connection having a semispherical portion interposed between said base and said footpad.

12. A foot switch comprising a base, a first set of spaced-apart pressure-sensitive switches arrayed about a first region of said base and a second set of spaced-apart pressure-sensitive switches spaced from said first set and arrayed about a second region of said base, a housing cover overlying said base and sets of switches, said cover having an upper surface formed with a ridge region overlying the space between said first and second sets of switches and having first and second support regions which substantially continuously downwardly from opposite sides of said ridge region over said first and second sets of switches, and first and second footpads mounted on said first and second support regions, respectively, inclined at the same angle as their respective support surfaces, each footpad having spaced-apart contact points thereon, with said first footpad overlying said first set of switches with each of its contact points facing an associated switch in said first set and said second footpad overlying said second set of switches with each of its contact points facing an associated switch in said second set, and support means supporting said footpads in normally nonactuating positions in which their contact points are spaced from said switches and permitting selected movement of each footpad independently of the other whereby selected contact points engage their associated switches.

13. The foot switch of claim 12, wherein said ridge region is inclined upwardly in a direction progressing from one end of said housing cover toward the opposite end, and said first and second support regions are also inclined upwardly in said direction.

14. A foot switch controller comprising a base, a first set of spaced-apart pressure-sensitive switches supported on said base, a second set of spaced-apart pressure-sensitive switches supported on said base in a region spaced from said first set of switches, a first footpad overlying said base and said first set of switches and a second footpad overlying said base and said second set of switches, each of said first and second footpads having an upper user-engaging surface and a plurality of spacedapart contact points thereon each of which faces an associated one of said switches, and support means for supporting said footpads in normally nonactuating positions in which said contact points are spaced from said switches and permitting selected movement of a footpad toward the base whereby selected contact points engage their associated switches, said support means comprising a housing cover having a central ridge region and oppositely disposed substantially planar first and second support regions which incline downwardly substantially continuously in opposite directions from opposite sides of said ridge region, said first footpad being mounted on and inclined with said first support region and said second footpad being mounted on and inclined with said second support region.

15. The foot switch of claim 14, which further comprises a third footpad and an associated underlying switch intermediate said first and second sets of switches and footpads, said third footpad being mounted in said ridge region of the housing cover.

16. The foot switch of claim 15, which further comprises a bumper on said housing cover projecting upwardly from said ridge region adjacent said third footpad and intermediate said first-mentioned and second footpads.

17. The foot switch of claim 14, in which said ridge region is inclined upwardly in a direction progressing from one end of said housing cover toward the other end and said support regions also are inclined upwardly in said direction.

18. The foot switch of claim 14, wherein said support means comprises a housing cover having an opening defined therein and said footpad comprises an elastomeric element supported in said opening with an upper user-engaging surface of the footpad spaced above the upper surface of said housing cover.

19. The foot switch of claim 18, wherein said elastomeric element has securing means adjacent its outer edges operable to secure said element to said housing cover.

20. The foot switch of claim 19, wherein said housing cover has a defined thickness at edge margins of said opening and said securing means comprises a peripheral groove defined in the outer margins of the elastomeric element having a groove width for receiving and gripping said housing cover edge margins.

21. The foot switch of claim 19, wherein said elastomeric element is a continuous integral member spanning the opening in said housing cover.

22. The foot switch of claim 21, wherein said elastomeric element has a user-engaging region of a first thickness permitting said region to project above the level of the housing cover and a flexing region spaced from said central region of lesser thickness to facilitate movement of said footpad between its nonactuating and actuating positions.

23. The foot switch of claim 22, wherein said flexing region has a multiple-bend bellows configuration.

24. The foot switch of claim 14, wherein said switches are arrayed about a central region on said base, said contact points are similarly arrayed about a central region of said footpad, and said support means comprises a universal swivel connection.

25. The foot switch of claim 24, wherein said universal swivel connection comprises a rigid swivel element having a semi-spherical portion interposed between said base and said footpad.

26. The foot switch of claim 14, wherein said first footpad is substantially circular, said first set of switches are arrayed on said base in preselected positions, the contact points on the first footpad are arrayed in preselected positions relative to said switch positions, and said housing cover and said first footpad include interactive means thereon to assure that said first footpad is correctly positioned on said housing to place said contact points adjacent their respective switches.

27. The foot switch of claim 26, wherein said interactive means comprises an engaging key and keyway on the first footpad and housing cover to inhibit rotation of the footpad about its central axis.

28. The foot switch of claim 25, wherein said housing cover has a defined thickness at the edge margins of the opening and said securing means comprises an annular groove defined in its outer margin having a groove width to receive and grip onto said housing cover edge margin.

* * * * *

UNITED STATES PATENT AND TRADEMARK OFFICE

CERTIFICATE OF CORRECTION

PATENT NO. : 5,340,953

DATED : August 23, 1994

INVENTOR(S) : Paul B. Krebs et al.

It is certified that error appears in the above-indentified patent and that said Letters Patent is hereby corrected as shown below:

On the title page:

Under "Other Publications," line 4, "Group" should read --Ground--.

Column 6, line 57
17), "FIG. 5" should read --FIG. 8--.

Column 7, line 49
"spacedapart" should read --spaced-apart--.

Column 8, line 17
"userengaging" should read --user-engaging--.

Column 8, line 59
"which substantially" should read --which incline substantially--.

Column 9, line 28
"spacedapart" should read --spaced-apart--.

Signed and Sealed this

Twenty-second Day of November, 1994

Attest:

Bruce Lehman

BRUCE LEHMAN

Attesting Officer

Commissioner of Patents and Trademarks